US008573930B2

(12) United States Patent
Woo et al.

(10) Patent No.: US 8,573,930 B2
(45) Date of Patent: Nov. 5, 2013

(54) NOZZLE ASSEMBLY OF VARIABLE GEOMETRY TURBOCHARGER

(75) Inventors: Soohyung Woo, Yongin-si (KR); Jinwook Son, Suwon-si (KR); Youngnam Kim, Hwaseong-si (KR); Jinkook Kong, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 483 days.

(21) Appl. No.: 12/896,717

(22) Filed: Oct. 1, 2010

(65) Prior Publication Data

US 2011/0097197 A1 Apr. 28, 2011

(30) Foreign Application Priority Data

Oct. 27, 2009 (KR) ..... 10-2009-0102034

(51) Int. Cl.
*F01D 17/14* (2006.01)

(52) U.S. Cl.
USPC ..... 415/163; 60/602

(58) Field of Classification Search
USPC ..... 415/148, 151, 159, 160, 163, 164, 165, 415/166
See application file for complete search history.

(56) References Cited

U.S. PATENT DOCUMENTS

| | | | | |
|---|---|---|---|---|
| 4,654,941 | A * | 4/1987 | Burdette et al. | 29/889.22 |
| 4,804,316 | A * | 2/1989 | Fleury | 417/407 |
| 7,001,142 | B2 | 2/2006 | Knauer et al. | |
| 2005/0252210 | A1 | 11/2005 | Shiraishi et al. | |
| 2008/0240906 | A1 * | 10/2008 | Barthelet et al. | 415/148 |

FOREIGN PATENT DOCUMENTS

| | | | |
|---|---|---|---|
| JP | 58-93902 | A | 6/1983 |
| JP | 2000-199433 | A | 7/2000 |
| JP | 2002-38963 | A | 2/2002 |
| JP | 2002-38964 | A | 2/2002 |
| JP | 2002-47941 | A | 2/2002 |
| JP | 2005-207373 | A | 8/2005 |
| JP | 2008309111 | A * | 12/2008 |
| KR | 10-0805971 | B1 | 2/2008 |

OTHER PUBLICATIONS

Translation of JP2008-309111A provided by Espacenet.*

* cited by examiner

*Primary Examiner* — Nathaniel Wiehe
*Assistant Examiner* — Justin Seabe
(74) *Attorney, Agent, or Firm* — Morgan, Lewis & Bockius LLP

(57) ABSTRACT

According to the present invention, it is possible to achieve improved durability by improving the connection structure of operation links and a control ring to reduce friction and wear between the operation links and the control ring, facilitate manufacturing by simple configuration and structure, and achieve silent and stable operation by making it possible to set the gaps between the parts relatively small.

7 Claims, 4 Drawing Sheets

NOZZLE ASSEMBLY OF VARIABLE GEOMETRY TURBOCHARGER

CROSS-REFERENCE TO RELATED APPLICATIONS

The present application claims priority to Korean Patent Application Number 10-2009-0102034 filed Oct. 27, 2009, the entire contents of which application is incorporated herein for all purposes by this reference.

BACKGROUND OF THE INVENTION

1. Field of the Invention

The present invention relates to a mechanism for operating a nozzle assembly of variable geometry turbocharger, and more particularly, to a mechanism adjusting rotational angle of vanes to control flow of an exhaust gas flowing through nozzles.

2. Description of Related Art

Variable geometry turbochargers of the related art have an exhaust pipe on the center axis of a turbine in a turbine housing such that the exhaust gas discharged from an internal combustion engine flows from the outside to the inside of the turbine and is exhausted from the turbochargers through the exhaust pipe, and the flow of the exhaust gas flowing into the turbine from the outside of the turbine is controlled by a nozzle assembly disposed outside the turbine.

The nozzle assembly of the related art includes a nozzle ring where a plurality of vanes are rotatably mounted in a circle; a nozzle plate disposed apart from the nozzle ring, with the vanes therebetween, to form a nozzle through which an exhaust gas passes; a control ring arranged coaxially with the nozzle ring to be able to rotate with respect to the nozzle ring and receive operation force for adjusting rotational angle of the vanes from the outside; and a plurality of operation links connecting the control ring with the rotational shafts of the vanes such that the vanes rotate, when the control ring rotates with respect to the nozzle ring.

The control ring has a plurality of connection portions where the ends of the operation links are fitted to transmit the relative rotation of the control ring to the nozzle ring as rotation force for the vanes. The connecting portion is a simple groove or hole, such that it causes significant friction and wear against the operational links, thereby decreasing durability.

Further, the connection structure between the connecting portions and the operation link is relatively complicated, such that machineability is bad. Further, the gaps between the parts are set relatively large in consideration of high-temperature thermal expansion, such that silence and stability are decreased and vibration may be generated in the operation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a nozzle assembly of a variable geometry turbocharger that has improved durability by improving the connection structure of operation links and a control ring to reduce friction and wear between the operation links and the control ring, can be easily manufactured by simple configuration and structure and achieve silent and stable operation by making it possible to set the gaps between the parts relatively small.

An exemplary embodiment of the present invention provides a nozzle assembly of a variable geometry turbocharger, which includes a nozzle ring where a plurality of vanes are rotatably mounted, a control ring arranged coaxially with the nozzle ring, a plurality of rollers rotatably mounted to the control ring, and a plurality of operation links connected with the vanes rotatably mounted to the nozzle ring, and inserted between the rollers.

According to the exemplary embodiment of the present invention, it is possible to achieve improved durability by improving the connection structure of operation links and a control ring to reduce friction and wear between the operation links and the control ring, facilitate manufacturing by simple configuration and structure, and achieve silent and stable operation by making it possible to set the gaps between the parts relatively small.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
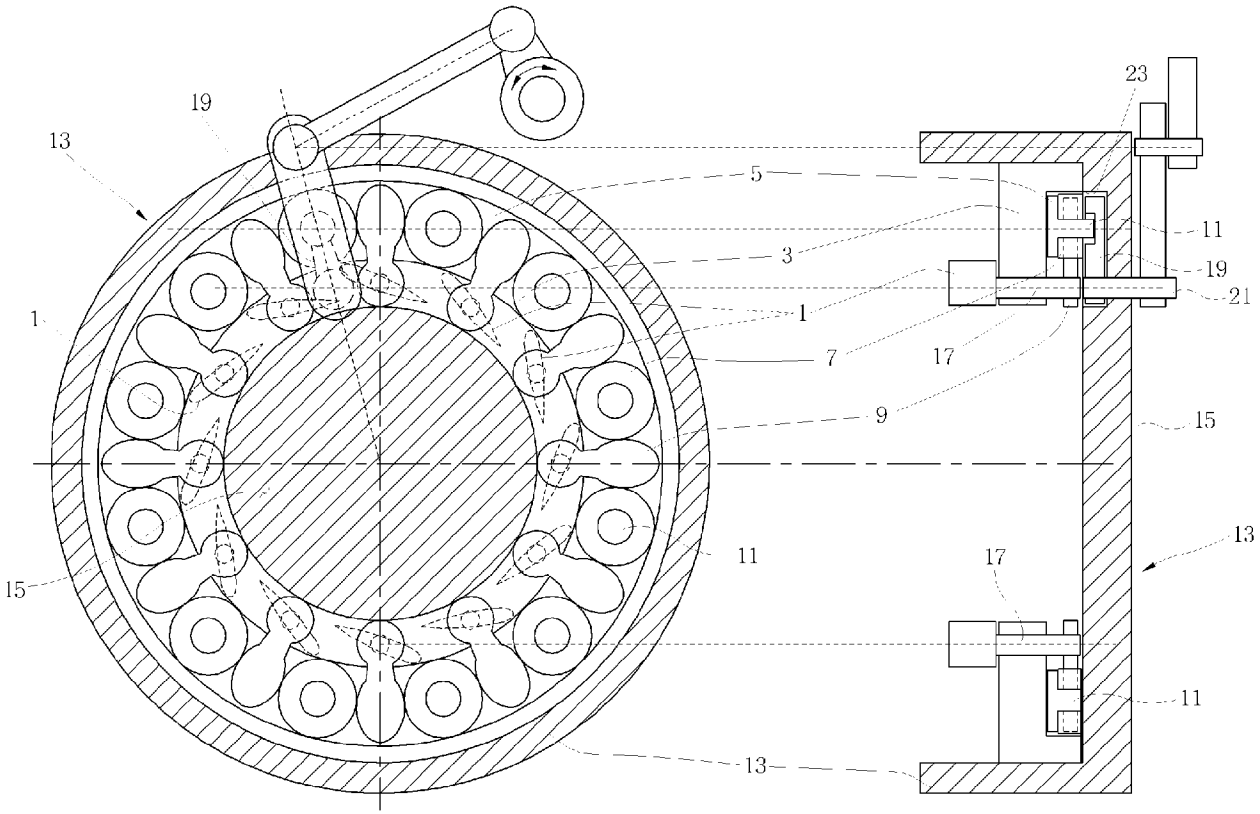
FIG. 1 is a view illustrating the structure of a nozzle assembly of a variable geometry turbocharger according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1, a nozzle assembly of a variable geometry turbocharger includes a nozzle ring 3 where a plurality of vanes 1 are rotatably mounted, a control ring 5 arranged coaxially with nozzle ring 3, a plurality of rollers 7 rotatably mounted to control ring 5, and a plurality of operation links 9 connected with vanes 1 rotatably mounted to nozzle ring 3 and inserted between rollers 7.

The rotational shaft of roller 7 is in arranged in parallel with the rotational axis of control ring 7 and the portion of operation link 9 between two rollers 7 is rounded to be in rolling-contact with rollers 7 while rollers 7 revolve.

That is, according to an exemplary embodiment of the present invention, the force supplied from control ring 5 to rotate vanes 1 is transmitted by rollers 7 and operation links 9. Therefore, since rollers 7 rotate while revolving with control ring 5, rolling-contact is made at the portions contacting operation links 9, such that friction and wear are not substantially generated.

The portion between two rollers 7 of operation link 9 is formed in an ellipse in the exemplary embodiment. This configuration is for continuously maintain the rolling-contact between operation links 9 and rollers 7 while absorbing changes in angle of operation links 9 positioned between adjacent two rollers 7, in which the changes in angle are caused by revolution and rotation of rollers 7 due to rotation of control ring 5.

Figure 3:
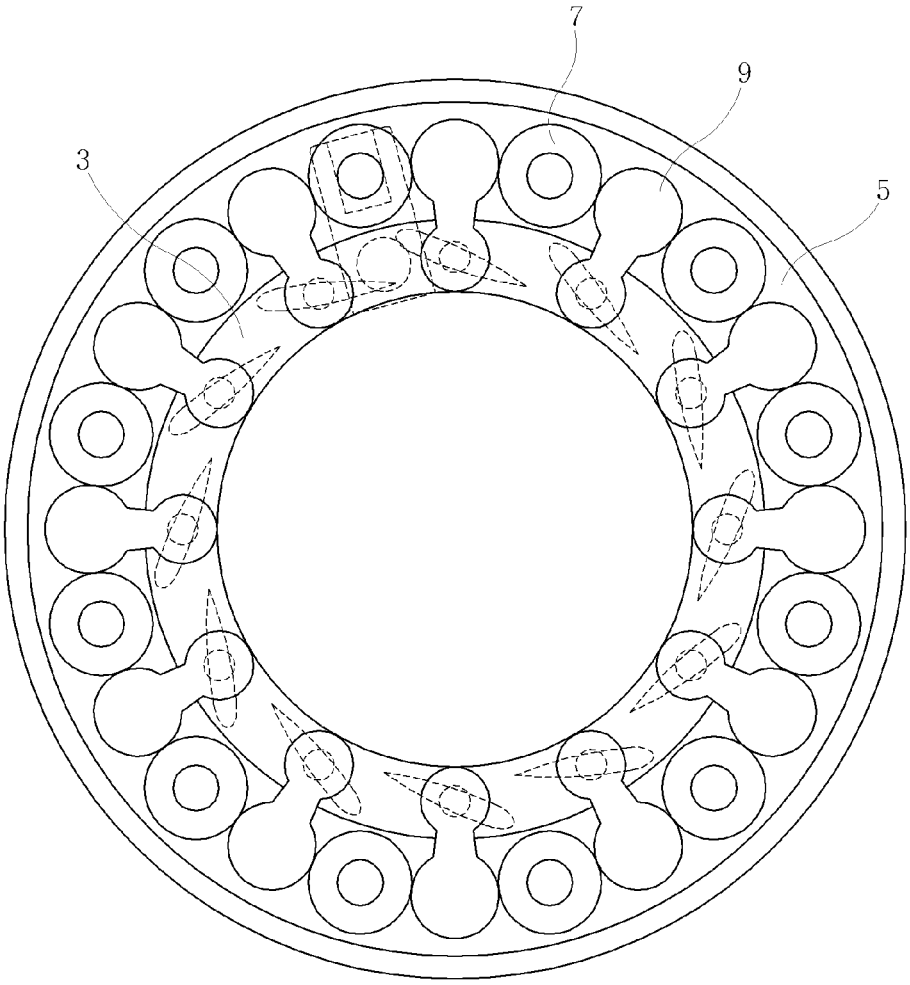
FIGS. 3 and 4 are views showing another exemplary embodiment of the exemplary embodiment shown in FIG. 1.

Although it is preferable to continuously maintain the rolling-contact of operation links 9 and rollers 7 within the rotational range of control ring 5, the portion positioned between two rollers 7 of operation link 9 may be formed in a circle, as shown in FIG. 3, in consideration of easy machineability, in which a small gap may be generated between rollers 7 and operation links 9 in accordance with the degree of rotation of control ring 5.

Control ring 5 has roller shaft protrusions 11 integrally protruding to function as the rotational shafts of rollers 7 and rollers 7 are formed in hollow cylindrical shape to be fitted on roller shaft protrusions 11.

The nozzle ring 3 is inserted in a turbo housing 13 in parallel with a flat wall 15 of turbo housing 13, control ring 5 is positioned between flat wall 15 of turbo housing 13 and nozzle ring 3, rollers 7 are rotatably arranged between control ring 5 and flat wall 15, vanes 1 are fixed to ends of nozzle rotation shafts 17 disposed through nozzle ring 3, and operation links 9 are fixed to the other ends of nozzle rotation shafts 17 and each have a free end inserted between rollers 7.

A control lever 19 is rotatably mounted to flat wall 15 of turbo housing 13 to transmit force for rotating control ring 5, such that control lever 19 receives rotational force from the outside through a control rotation shaft 21 disposed through flat wall 15.

An independent operation lever is connected to control rotation shaft 21 and a device, such as a motor, a pneumatic actuator, or a hydraulic actuator to make it possible to adjust the operational angle of vanes 1 by operating control rotation shaft 21, using a controller, such as an engine controller.

It is possible to achieve more compact configuration by allowing control lever 19 to operate while being inserted in a link mount groove 23, which is a space formed in flat wall 15 of turbo housing 13.

Figure 4:
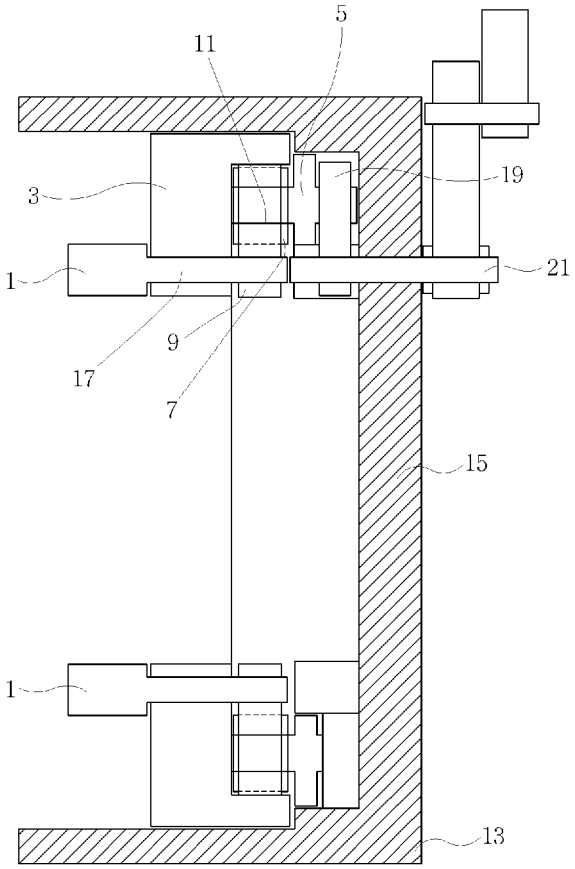

FIG. 4 shows another exemplary embodiment having a little different arrangement from the exemplary embodiment shown in FIG. 1, in which a nozzle ring 3 is inserted in a turbo housing 13 in parallel with a flat wall 15 of turbo housing 13, a control ring 5 is positioned between flat wall 15 of turbo housing 13 and nozzle ring 3, rollers 7 are rotatably arranged between control ring 5 and nozzle ring 3, vanes 1 are fixed to ends of nozzle rotation shafts 17 disposed through nozzle ring 3, and operation links 9 are fixed to the other ends of nozzle rotation shafts 17 and each have a free end inserted between rollers 7, such that rollers 7 and control ring 5 are arranged opposite to the structure shown in FIG. 1.

The control ring 5 and the control lever 19 may be rotatably embedded into the flat wall 15 with a predetermined length to transmit a rotational force.

Figure 2:
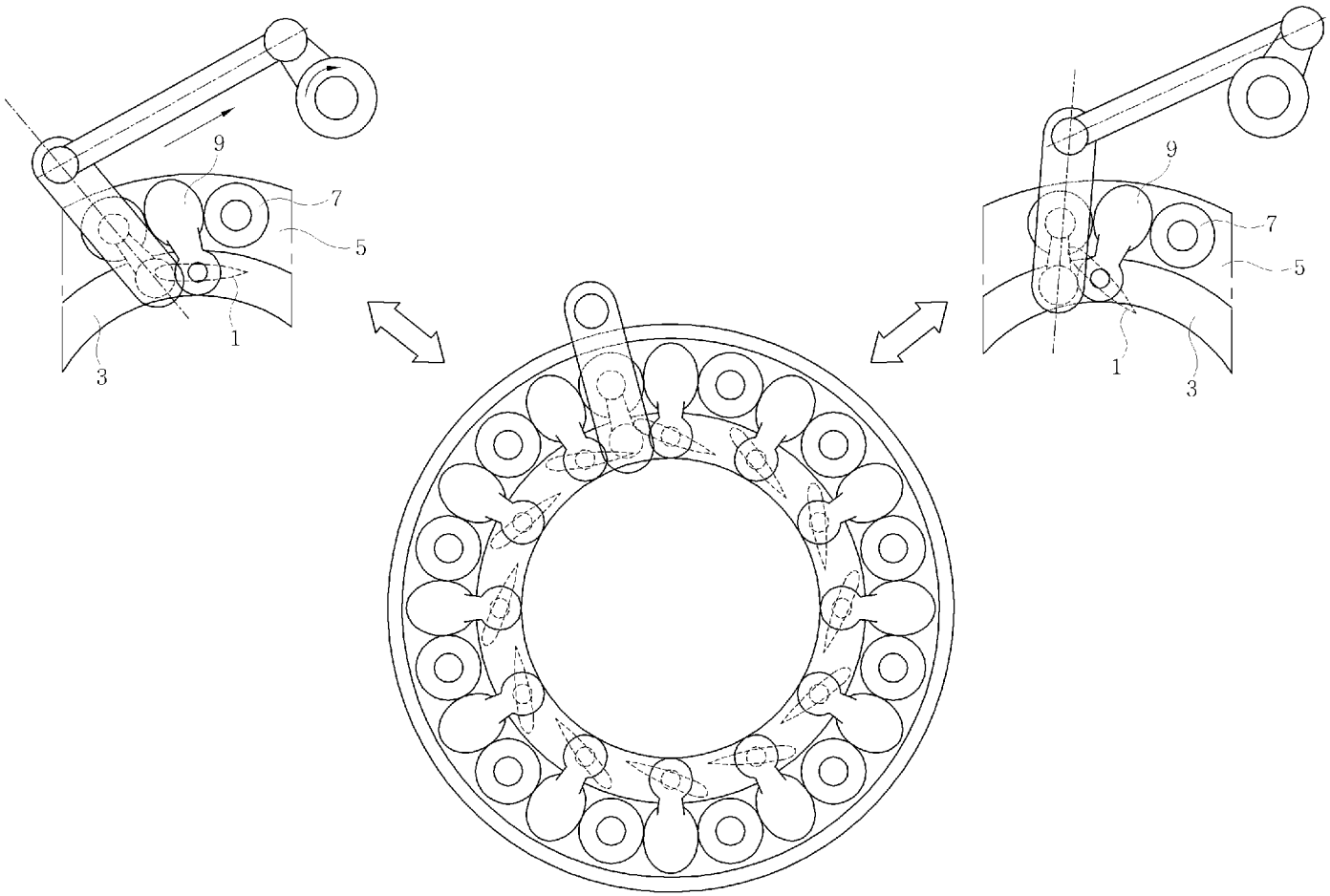
FIG. 2 is a view illustrating the operation of the exemplary embodiment shown in FIG. 1.

FIG. 2 illustrates the operation of the nozzle assembly according to the exemplary embodiment shown in FIG. 1, in which as rotational force is transmitted from the outside to control lever 19 through control rotation shaft 21, control lever 19 rotates control ring 5 coaxially with nozzle ring 3 and the rotation of control ring 5 makes revolution of rollers 7. Accordingly, as rollers 7 rotate and revolve, operation links 9 fitted in between adjacent rollers 7 are rotated while maintaining rolling-contact and the rotational force of operation links 9 is directly transmitted to vanes 1 through nozzle rotation shafts 17, such that rotational angle of vanes 1 changes, and accordingly, it is possible to control flow of an exhaust gas passing them.

Since rollers 7 and operation links 9 that convert the rotational motion of control ring 5 into the rotational motion of vanes 1 maintain the rolling-contact within the entire rotational range of control ring 5, operational friction and wear are considerably reduced. Further, since the structures of rollers 7 and operation links 9 are simple, manufacturing is easy. Furthermore, since it is possible to set the gaps between the parts relatively small in consideration of high-temperature thermal expansion, it is possible to improve silence and stability in the operations.

For convenience in explanation and accurate definition in the appended claims, the terms "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A nozzle assembly of a variable geometry turbocharger, comprising:

a nozzle ring where a plurality of vanes are rotatable mounted along a circumferential surface thereof;

a control ring arranged coaxially with the nozzle ring and is relatively rotatable with respect to the nozzle ring;

a plurality of rollers rotatably mounted to the control ring along a circumferential surface thereof; and a plurality of operation links, one end of which is rotatably coupled to the control ring and the other end of which is fixed to the vanes through the nozzle ring;

wherein the one end of the operation link is positioned between adjacent rollers along the circumferential surface of the control ring;

wherein the control ring is disposed between the nozzle ring and a flat wall of a turbo housing with a predetermined gap from the nozzle ring;

wherein the control ring has roller shaft protrusions integrally protruding in a predetermined distance and the rollers are formed in a hollow cylindrical shape to be fitted on the roller shaft protrusions;

wherein the rollers are rotatably arranged between the control ring and the nozzle ring;

wherein the vanes are fixed to one ends of nozzle rotation shafts disposed through the nozzle ring; and wherein the other ends of the operation links are fixed to the other ends of the nozzle rotation shafts between the control ring and the nozzle ring.

2. The nozzle assembly of the variable geometry turbocharger as defined in claim 1, wherein rotational shafts of the rollers are in arranged in parallel with a rotational axis of the control ring, and wherein the one end of the operation link between the adjacent rollers is rounded to be in rolling-contact with the adjacent rollers while the adjacent rollers revolve by rotation of the control ring.

3. The nozzle assembly of the variable geometry turbocharger as defined in claim 2, wherein the one end of the operation link between the adjacent rollers is formed in an ellipse.

4. The nozzle assembly of the variable geometry turbocharger as defined in claim 2, wherein the one end of the operation link between the adjacent rollers is formed in a circle.

5. The nozzle assembly of the variable geometry turbocharger as defined in claim 1, wherein the control ring slidably contacts the nozzle ring between the nozzle ring and a flat wall of a turbo housing, and wherein the nozzle ring is inserted in and fitted into the turbo housing in parallel with the flat wall of the turbo housing in a radial direction.

6. The nozzle assembly of the variable geometry turbocharger as defined in claim 1, wherein one end of a control lever being connected to a control rotation shaft through the flat wall is rotatably mounted to the flat wall of the turbo housing and the other end of the control lever is rotatably fixed to the control ring, such that the control lever receives a rotational force from the outside through the control rotation shaft and rotates the control ring.

7. The nozzle assembly of the variable geometry turbocharger as defined in claim 6, wherein the control ring and the control lever are rotatably embedded into the flat wall with a predetermined length to transmit the rotational force.

* * * * *